US009889864B2

(12) United States Patent
Yu et al.

(10) Patent No.: US 9,889,864 B2
(45) Date of Patent: Feb. 13, 2018

(54) RAILWAY VEHICLE AND HEAD VEHICLE BARRIER-REMOVING DEVICE THEREOF

(71) Applicant: CRRC QINGDAO SIFANG CO., LTD., Qingdao, Shandong (CN)

(72) Inventors: Yangyang Yu, Shandong (CN); Guanglei Ma, Shandong (CN); Aiqin Tian, Shandong (CN); Shizhong Zhao, Shandong (CN); Sansan Ding, Shandong (CN); Wenbin Chen, Shandong (CN); Quanwei Che, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 0 days.

(21) Appl. No.: 15/325,533

(22) PCT Filed: Nov. 5, 2015

(86) PCT No.: PCT/CN2015/093870
§ 371 (c)(1),
(2) Date: Jan. 11, 2017

(87) PCT Pub. No.: WO2016/095624
PCT Pub. Date: Jun. 23, 2016

(65) Prior Publication Data

US 2017/0174233 A1 Jun. 22, 2017

(30) Foreign Application Priority Data

Dec. 15, 2014 (CN) ..... 2014 1 0778086
Dec. 15, 2014 (CN) ..... 2014 2 0796604 U

(51) Int. Cl.
*B61F 19/06* (2006.01)
*B61F 19/04* (2006.01)
*B61D 15/06* (2006.01)

(52) U.S. Cl.
CPC ..... *B61F 19/06* (2013.01); *B61D 15/06* (2013.01); *B61F 19/04* (2013.01)

(58) Field of Classification Search
CPC . B61F 19/04; B61F 19/06; B61F 1/10; B61D 15/06; B60R 19/16; B60R 2021/009; B61G 9/20
(Continued)

(56) References Cited

U.S. PATENT DOCUMENTS 6,167,815 B1 * 1/2001 Werner ..... B61F 19/04 105/392.5
9,409,580 B2 * 8/2016 Fan ..... B61F 19/04
(Continued)

FOREIGN PATENT DOCUMENTS

CN 1537768 A 10/2004
CN 200945867 Y 9/2007
(Continued)

OTHER PUBLICATIONS

Summary of the 2nd Office Action for CN201410778086.0, dated Jan. 22, 2017.
(Continued)

*Primary Examiner* — Zachary L Kuhfuss
(74) *Attorney, Agent, or Firm* — U.S. Fairsky LLP; Yue Xu

(57) ABSTRACT

A railway vehicle and a head car cowcatcher thereof are provided. The head car cowcatcher includes a flow guiding plate; a front-end frame mounted at a front end of an inner side surface of the flow guiding plate; and longitudinal sills mounted at two sides of the inner side surface of the flow guiding plate. Two ends of the front-end frame are respectively connected to the longitudinal sills located at the two sides. The rigidity of a connecting part of the longitudinal sills and the front-end frame is smaller than the rigidities of
(Continued)

any parts of the longitudinal sills and the front-end frame. When obstructions are cleared or a train collision occurs, the connecting part of the front-end frame and each of the longitudinal sills would be largely deformed if the impact force the cowcatcher bears is beyond the maximum load the cowcatcher can bear.

12 Claims, 1 Drawing Sheet

(58) Field of Classification Search
USPC ..... 293/48, 107; 105/173, 392.5; 213/9, 213/220, 221
See application file for complete search history.

(56) References Cited

U.S. PATENT DOCUMENTS

| | | | | |
|---|---|---|---|---|
| 2007/0186802 | A1* | 8/2007 | Gough | B61D 15/06 105/392.5 |
| 2013/0239847 | A1* | 9/2013 | Taguchi | B61D 17/06 105/392.5 |
| 2014/0290528 | A1* | 10/2014 | Fan | B61F 19/04 105/392.5 |

FOREIGN PATENT DOCUMENTS

| | | | |
|---|---|---|---|
| CN | 201882106 | U | 6/2011 |
| CN | 202935363 | U | 5/2013 |
| CN | 103180194 | A | 6/2013 |
| CN | 103661476 | A | 3/2014 |
| CN | 203844763 | U | 9/2014 |
| CN | 104527704 | A | 4/2015 |
| CN | 204279474 | U | 4/2015 |
| JP | 2001055141 | A | 2/2001 |
| JP | 2003137094 | A | 5/2003 |
| JP | 2005206006 | A | 8/2005 |
| JP | 2006168707 | A | 6/2006 |
| JP | 2006327452 | A | 12/2006 |
| JP | 2007320442 | A | 12/2007 |
| JP | 4124922 | B2 | 7/2008 |
| JP | 2013199135 | A | 10/2013 |

OTHER PUBLICATIONS

International Search Report for PCT/CN2015/093870, dated Feb. 17, 2016, ISA/CN.

* cited by examiner

RAILWAY VEHICLE AND HEAD VEHICLE BARRIER-REMOVING DEVICE THEREOF

This application is the national phase of international Application No. PCT/CN2015/093870, titled "RAILWAY VEHICLE AND HEAD VEHICLE BARRIER-REMOVING DEVICE THEREOF", filed on Nov. 5, 2015, which claims the benefits of priorities to Chinese patent application No. 201410778086.0, titled "RAIL VEHICLE AND HEAD CAR COWCATCHER THEREOF", filed with the Chinese State Intellectual Property Office on Dec. 15, 2014 and Chinese patent application No. 201420796604.7, titled "RAIL VEHICLE AND HEAD CAR COWCATCHER THEREOF", filed with the Chinese State Intellectual Property Office on Dec. 15, 2014, the entire disclosures of which applications are incorporated herein by reference.

FIELD

The present application relates to the technical field of vehicle safety, and particularly to a rail vehicle and a head car cowcatcher thereof.

REARGROUND

With operating speed of rail vehicles gradually increasing, passive safety design of trains receives more and more attention. Generally, a cowcatcher is provided at the bottom of a front end of a head car of an express train such as high-speed motor train units to clear obstructions on a track to guarantee that the train would be safe during normal running.

Presently, in the conventional design process of the cowcatcher, often, only the capability of clearing obstructions on a track surface is considered. Therefore, when obstruction removing structures for trains of different speed levels are designed, explicit requirements are imposed on lower limiting value of the obstruction removing capabilities of the obstruction removing structures, while no explicit requirements are imposed on upper limiting values thereof. However, when an obstruction on the track is too large or two trains collide with each other, and if the rigidity of the cowcatcher at the front end of the head car of a rail vehicle is too large (namely, a maximum load force borne by the cowcatcher is too large), it may cause that vertical distribution of rigidity of the section of the front end of the head car becomes out of balance, the energy absorbing characteristic of the energy absorbing structure provided at the front end of the motor train units would be degraded and further the risks such as climbing or derailment of the train would be increased. Therefore, the structural rigidity of the cowcatcher at the front end of the head car should be controlled to improve the operation safety of the train.

Thus, a technical issue to be addressed by those skilled in the art presently is to design a head car cowcatcher of a rail vehicle, so as to improve an operation safety of the train, and avoid risks, such as climbing or derailment, caused by failing to effectively absorb impact energy due to the hindrance of the cowcatcher when a collision accident occurs.

SUMMARY

An object of the present application is to provide a rail vehicle and a head car cowcatcher thereof. When a collision accident occurs, the cowcatcher is capable of moving rearward timely to free up a space for an energy absorbing component of the head car, thus guaranteeing the energy absorbing characteristic of the energy absorbing component, and further improving the passive safety of the vehicle, thereby preventing safety accidents such as climbing or derailment from occurring.

To address the above technical issue, a head car cowcatcher of a rail vehicle is provided according to the present application. The head car cowcatcher includes a flow guiding plate; a front-end frame mounted at a front end of an inner side surface of the flow guiding plate; and longitudinal sills mounted to the inner side surface and located at two sides of the flow guiding plate respectively. Two ends of the front-end frame are connected to the longitudinal sills located at the two sides respectively. The rigidity of a connecting part of each longitudinal sill and the front-end frame is smaller than the rigidities of any parts of the longitudinal sills and the front-end frame.

In the head car cowcatcher according to the present application, the connecting part of the front-end frame and each longitudinal sill is weakened in rigidity to form a deformable structure at the connecting part of the front-end frame and each longitudinal sill. When clearance of obstructions is being performed or a train collision occurs, the connecting part of the front-end frame and each longitudinal sill would be largely compressively deformed if the impact force the cowcatcher bears is beyond the maximum load the cowcatcher can bear. Then the front end of the flow guiding plate is caused to retract rearward gradually to free up a space for an energy absorbing component mounted at the front end of the head car, thus guaranteeing that the energy absorbing component can effectively absorb the impact energy. Therefore, the passive safety of the vehicle is improved, and safety accidents such as climbing or derailment are prevented from occurring.

Optionally, the front-end frame and the longitudinal sill are both formed by assembly welding of plates, and a thickness of the plates for the connecting part is smaller than a thickness of the plates for any parts of the longitudinal sills and the front-end frame.

Optionally, a transverse size of the plates for the connecting part is smaller than a transverse size of the plates for any parts of the longitudinal sills and the front-end frame.

Optionally, the connecting part of each longitudinal sill and the front-end frame is made of a material with a rigidity smaller than rigidities of materials of the longitudinal sills and the front-end frame.

Optionally, a through hole is opened in a front end of each of the longitudinal sills to allow the front end of each of the longitudinal sills to be connected to the front-end frame to form the connecting part.

Optionally, the flow guiding plate is arranged in a V shape, and the front-end frame has a sector shape and is welded to a top surface of the flow guiding plate.

Optionally, an obstruction removing plate is connected to a front end of the flow guiding plate, and obstruction removing rubbers are respectively connected to two sides of the flow guiding plate.

Optionally, a cross beam is connected to rear ends of the longitudinal sills, and a first connecting hole for facilitating the connection with a vehicle body of a head car is provided in the cross beam.

Optionally, a connection hanger bracket is provided at a top surface of each of the longitudinal sills, and the connection hanger bracket is provided with a second connecting hole for connection to an underframe of the head car.

A rail vehicle is further provided according to the present application, which includes the head car cowcatcher according to any one of the above aspects.

Since the rail vehicle according to the present application includes the head car cowcatcher according to any one of the above aspects, the technical effects generated by the head car cowcatcher according to any one of the above aspects are all applicable to the rail vehicle according to the present application. It would not be described herein.

BRIEF DESCRIPTION OF THE DRAWINGS

For more clearly illustrating embodiments of the present application or technical solutions in the conventional technology, drawings referred to describe the embodiments or the conventional technology will be briefly described hereinafter. Apparently, the drawings in the following description are only some examples of the present application, and for those skilled in the art, other drawings may be obtained based on these drawings without any creative efforts.

Figure 1:
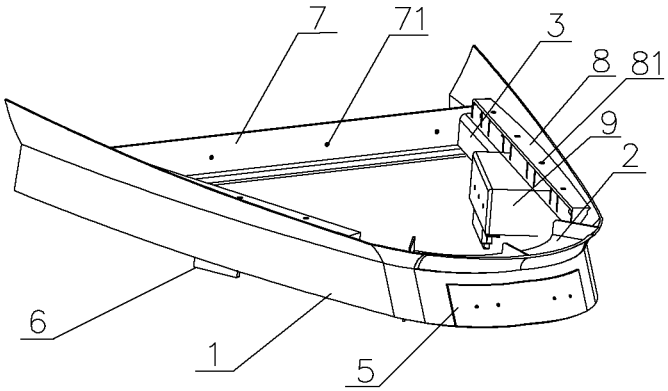
FIG. 1 is a schematic view showing the stereoscopic structure of a head car cowcatcher of a rail vehicle according to an embodiment of the present application.
Figure 2:
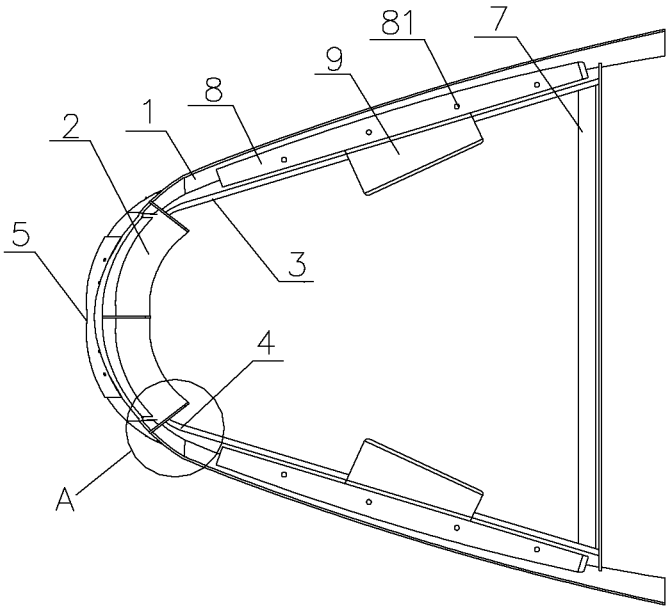
FIG. 2 is a top view of the head car cowcatcher in FIG. 1.

Reference numerals in FIGS. 1 to 2:

1 flow guiding plate,
2 front-end frame,
3 longitudinal sill,
4 connecting part,
5 obstruction removing plate,
6 obstruction removing rubber,
7 cross beam,
71 first connecting hole,
8 connection hanger bracket,
81 second connecting hole, and
9 obstruction removing rubber clamping plate.

DETAILED DESCRIPTION

To make the objects, technical solutions and advantages of the embodiments of the present application more clear, the technical solutions of the embodiments of the present application will be clearly and completely described hereinafter in conjunction with the drawings of the embodiments of the present application. Apparently, the embodiments described are a part of embodiments, rather than all embodiments of the present application. Other embodiments obtained by those skilled in the art based on the embodiments of the present application without any creative efforts all fall into the protection scope of the present application.

The core of the present application is to provide a rail vehicle and a head car cowcatcher thereof. When a collision accident occurs, the cowcatcher is capable of moving rearward timely to free up a space for an energy absorbing component of the head car, thus guaranteeing the energy absorbing characteristics of the energy absorbing component and further improving the passive safety of the vehicle, thereby preventing safety accidents such as climbing or derailment from occurring.

A head car cowcatcher is usually provided in a rail vehicle to clear obstructions on a track to guarantee that the train would be safe during normally running. The head car cowcatcher according to the present application will be illustrated in detail hereinafter in conjunction with the drawings and embodiments to enable those skilled in the art to more accurately understand the present application.

For ease of description, common basic orientations for trains are used herein to define directions. A direction in parallel with the direction in which the train runs is a longitudinal direction. In the longitudinal direction, the direction directed to the front of the running train is a front direction, and the direction directed to the rear of the running train is a rear direction. In a plane in parallel with the track surface, a direction perpendicular to the longitudinal direction is a transverse direction. In the transverse direction, when seen along the direction in which the train runs, the direction directed to the left side is a left direction, and the direction directed to the right side is a right direction. A direction perpendicular to the track surface is a vertical direction. In the vertical direction, the direction close to the track surface is a downward direction, and the direction away from the track surface is an upward direction.

A head car cowcatcher of a rail vehicle is provided according to the present application. The head car cowcatcher mainly includes a flow guiding plate 1 and an internal frame supported inside the flow guiding plate 1. The overall shape of the flow guiding plate 1 may be a V-like shape. The outline of the flow guiding plate 1 matches a radian of the driver's cab of the head car in order to be easily mounted at the bottom of the driver's cab. Two sides of the flow guiding plate 1 may be formed by splicing two flexed plates intersecting with each other at a certain angle. The two flexed plates may be connected by an arc-shaped plate in the middle to form the plate with the overall V-like shape. The flow guiding plate 1 has air guiding function, so that the requirement for well aerodynamic performance of the head car is satisfied, and the flow guiding plate 1 has a certain capability of removing obstructions, thus obstructions on a track may be cleared.

The internal frame includes a front-end frame 2 and longitudinal sills 3, and is supported inside the flow guiding plate 1 and constitutes a supporting structure of the entire head car cowcatcher. The front-end frame 2 is a frame connected to a front end of an inner side surface of the flow guiding plate 1 for supporting the front end of the flow guiding plate 1. The longitudinal sills 3 are connected to the inner side surface and respectively located at two sides of the flow guiding plate 1 and extend substantially in the longitudinal direction of a vehicle body, i.e., in the length direction of the entire flow guiding plate 1 from front to rear, to support the two sides of the flow guiding plate 1. Two sides of the front-end frame 2 are connected to the longitudinal sills 3 located at the same sides as the two sides of the front-end frame 2, respectively. A connecting part 4 of the front-end frame 2 and each of the longitudinal sills 3 is weakened in rigidity. That is, the rigidity of the connecting part 4 is smaller than the rigidity of any parts of each of the front-end frame 2 and the longitudinal sill 3. When a collision occurs, according to the principle that a part with a small rigidity would be deformed first, an extrusion deformation is inevitably generated at the connecting part 4, and further the front-end frame 2 is moved rearward to retract, thus freeing a space for an energy absorbing component arranged on a front end of the head car, thereby facilitating effective energy absorption, and avoiding safety accidents such as climbing or derailment caused by energy being not absorbed.

The energy absorbing component arranged on the head car includes an energy absorbing anti-climber, a thin-wall energy absorbing member, etc. The energy absorbing component is usually mounted on an airtight wall located at a front end of the driver's cab, or mounted on another plate body in the same vertical plane along the longitudinal direction as a cross beam 7 (referring to the description hereinafter regarding the cross beam 7) of the cowcatcher, inside the driver's cab.

Besides, in one connection way of the head car cowcatcher, a rear end of the head car cowcatcher may be connected to the airtight wall of the driver's cab. In this case, a part of or the entire energy absorbing component arranged at the head car is exactly located above the head car cowcatcher. Since the energy absorbing component requires a large stroke space when absorbing energy, the energy absorbing characteristics of the energy absorbing component may be adversely affected if the rigidity of the head car cowcatcher is too large, and further the collision energy cannot be effectively absorbed, finally resulting in safety accidents such as climbing or derailment.

In view of the above situation, the connecting part 4 of the longitudinal sill 3 and the front-end frame 2 is weakened in rigidity in the present application. In one aspect, the rigidities of the longitudinal sill 3 and the front-end frame 2 may be maintained large to meet the requirements for strength of clearing the obstructions, thus meeting the obstruction removing requirement of the cowcatcher. In another aspect, when the train encounters a large obstruction or a collision occurs to the train, the front-end frame 2 directionally moves rearward toward the connecting part 4 if a load the cowcatcher bears is larger than the maximum load the cowcatcher can bear. This means that the front end of the head car cowcatcher retracts rearward, thus freeing the space at the front. This space constitutes a part of the stroke space required by the energy absorbing component for absorbing energy, thus the energy absorbing component can effectively absorb the collision energy, and avoiding major safety accidents such as climbing or derailment caused by too large energy.

The connecting part 4 is a part where the longitudinal sill 3 and the front-end frame 2 are connected to each other. Specifically, the connecting part 4 may be an area formed by the enlargement of the connecting part of the longitudinal sill 3 and the front-end frame 2, as shown by portion A in FIG. 2.

Specifically, there are a variety of ways to weaken the rigidity of the connecting part 4. For example, the structure size, structure form and material properties of the connecting part 4 may be changed to adjust the rigidity of the connecting part 4 to be smaller than the rigidity of any parts of the longitudinal sill 3 and front-end frame 2. The connecting part 4 forms a deformable part "arranged beforehand" equivalently. In the case that the load the cowcatcher bears is beyond the maximum load the cowcatcher can bear, the connecting part 4 is deformed, and then the front end of the entire cowcatcher moves rearward, freeing a space for the energy absorbing component.

In an embodiment, the structure size of the connecting part 4 may be changed to realize weakening of the rigidity.

As shown in FIGS. 1 and 2, the front-end frame 2 and the longitudinal sill 3 may be both formed by assembly welding of plates. In this case, a thickness of the plates used by the connecting part 4 may be smaller than a thickness of the plates used by any parts of the longitudinal sill 3 and the front-end frame 2. That is, the thickness of the plates used by the connecting part 4 is made small by processing, thus the rigidity of the plates used by the connecting part 4 is reduced and the flexibility thereof is increased, thereby forming a weakened link on the connecting part 4. Therefore, the connecting part 4 would be deformed when the head car cowcatcher is impacted by an extremely large load. Apparently, it should be understood by those skilled in the art that, the weakened link on the connecting part 4 is only an iconic illustration and not intended to demonstrate that there is really an unreliable connection part in the connecting part 4, on the contrary, it means that the rigidity of the connecting part 4 is relatively weak and thus the entire connecting part 4 is apt to be deformed. However, the rigidity of the connecting part 4 is still sufficient to guarantee that small-sized obstructions on the track can be cleared, simply the rigidity of the connecting part 4 is smaller than the rigidities of the longitudinal sill 3 and the front-end frame 2.

Furthermore, a transverse size of the connecting part 4 may also be reduced. That is, the transverse size of the plates used by the connecting part 4 is reduced to be smaller than a transverse size of the plates used by any parts of the longitudinal sill 3 and the front-end frame 2, namely narrowing the connecting part 4 to reduce the rigidity of the connecting part 4.

Thus, various structure sizes of the connecting part 4 may be adjusted, and particularly the thickness and width of the connecting part 4 may be adjusted to make the connecting part 4 become a thinner and narrower connecting plate. In this way, the connecting part 4 naturally forms a part with a small rigidity. In the case that the load is too large, the connecting part 4 may be deformed, thus freeing a space for the energy absorbing component.

From the teaching of the above technical solutions in which the thickness and transverse size of the connecting part 4 are adjusted, those skilled in the art may understand that other structure sizes of the connecting part 4 may be changed to reduce the rigidity of the connecting part 4 and thus increasing the flexibility thereof.

In another embodiment, the structure form of the connecting part 4 may also be changed to reduce the rigidity of the connecting part 4. For example, a through hole may be opened at a front end of the longitudinal sill 3, and then a portion of the longitudinal sill 3 where the through hole is opened is connected to the front-end frame 2. Thus the part where the longitudinal sill 3 and the front-end frame 2 are connected constitutes the connecting part 4. Due to the presence of a hollow portion, i.e., the through hole, the overall rigidity of the connecting part 4 having the hollow portion would be inevitably smaller than the rigidity of the connecting part 4 of a solid structure in the case that the space occupied by the connecting part 4 is certain. Therefore, the above through hole may weaken the rigidity of the connecting part 4.

Specifically, the longitudinal sill 3 is generally configured as a groove-shaped structure. That is, the longitudinal sill 3 includes two side plates which are angled with respect to each other, one of the side plates is generally fixed to the flow guiding plate 1 by welding, and the other side plate may extends in a substantially transverse direction. The through hole may be opened in the other side plate, and in this case, the through hole may be a through hole running through from top to bottom. That is, the through hole extends through the other side plate. Of course, the longitudinal sill 3 may also be of other structure forms, and in this case, a direction in which the through hole runs through may be changed to some extent. Therefore, the through hole is not limited to the above through hole running through from top to bottom.

It may be further appreciated that, those skilled in the art may alternatively provide the through hole or other structures in the front-end frame 2 and/or the longitudinal sill 3 as required in order to reduce the rigidity of the connecting part 4. In other words, a position of the through hole is not limited herein. The through hole may be opened at any positions of the connecting part 4 and is not limited to be opened in the longitudinal sill 3. Apparently, any position of the connecting part 4 described above refers to any parts of the front-end frame 2 or the longitudinal sill 3 where connection is performed, not including other components which are connected to the front-end frame 2 or the longitudinal sill 3, namely, not including the flow guiding plate 1. Of course, it is easy to open the through hole in the longitudinal sill 3 and processing accuracy is easily guaranteed.

The through hole may be of various structure forms. For example, the through hole may be an oblong hole with a length direction consistent with the longitudinal direction or may be a hole of other shapes. The structure form of the oblong hole may have a function of weakening the rigidity of the connecting part 4 as well as may reduce adverse effects on the longitudinal sill 3 as much as possible, and maximally reduce adverse effects on the functional performance of the head car cowcatcher.

From the teaching of the above technical solution in which the through hole is opened, those skilled in the art may improve the structure of the plates for the connecting part 4. For example, the plates for the connecting part 4 may be configured as a hollow plate or similar structures to reduce the rigidity of the connecting part 4.

In yet another embodiment, the connecting part 4 according to the present application may also be made of a special material. That is, the connecting part 4 may be made of a material different from materials of the front-end frame 2 and the longitudinal sill 3 to allow the rigidity of the connecting part 4 to be smaller than the rigidity of either of the front-end frame 2 and the longitudinal sill 3. That is, the rigidity of the connecting part 4 is reduced by changing the properties of the material for the connecting part 4. For example, the connecting part 4 may be made of a material with a small rigidity and a certain flexibility such as aluminium, while the front-end frame 2 and the longitudinal sill 3 may be made of constructional steel material to allow the front-end frame 2 and the longitudinal sill 3 to have a certain rigidity, thus meeting obstruction clearing requirements.

Apparently, those skilled in the art may adopt other materials to manufacture the connecting part 4 to allow the rigidity of the connecting part 4 to be smaller than the rigidities of the longitudinal sill 3 and the front-end frame 2.

Based on the above embodiments, the overall shape of the flow guiding plate 1 according to the present application may generally be a V shape, as shown in FIGS. 1 and 2. Also, the front-end frame 2 may be of a sector-like shaped structure, and may be welded to a top surface of the flow guiding plate 1 to correspond to a tip top area of the V-shaped structure of the flow guiding plate 1. Of course, the overall shape of the flow guiding plate 1 is generally a V shape, however a head of the flow guiding plate 1 is not arranged in a tip top shape but is smoothly transited and connected with a certain radian, thus matching a radian of the driver's cab of the head car. Therefore, the front-end frame 2 welded at a top portion of the inner side surface of the flow guiding plate 1 may be arranged in a sector shape so as to match the flow guiding plate 1. Furthermore, for ease of connection and use, the front-end frame 2 is obliquely downward inclined from front to rear. In this way, in one aspect the front end of the flow guiding plate 1 may be effectively supported in the whole vertical direction, and in another aspect, the underframe of the head car would not be interfered.

Further, the head car cowcatcher according to the present application further includes an obstruction removing plate 5 and an obstruction removing rubber 6. The obstruction removing plate 5 is mounted at the front end of the flow guiding plate 1 and the obstruction removing rubber 6 is mounted at each of the two sides of the flow guiding plate 1, as shown in FIGS. 1 and 2.

Bolts may be used to fix the obstruction removing plate 5 and the obstruction removing rubbers 6 to the flow guiding plate 1 via oblong holes or similar structures, or other dismountable connecting pieces may be adopted to realize mounting of the obstruction removing plate 5 and the obstruction removing rubbers 6, so as to adjust a height away from the track surface and to allow the head car cowcatcher to keep the same height away from the track surface when the vehicle is in operation.

The obstruction removing rubber 6 generally extends out downwardly from the flow guiding plate 1. To realize the mounting of the obstruction removing rubber 6, obstruction removing rubber clamping plates 9 may be welded to portions of an inner surface, at the two sides, of the flow guiding plate 1. Then the obstruction removing rubber 6 is connected to the obstruction removing rubber clamping plate 9 by using bolts, as shown in FIGS. 1 and 2.

Yet further, the head car cowcatcher according to the present application may further include a cross beam 7. The cross beam 7 is mounted at rear ends of the longitudinal sills 3, and the cross beam 7 is connected to the longitudinal sills 3 located at the two sides through two ends of the cross beam 7, respectively. A first connecting hole 71 may be opened in the cross beam 7 to facilitate the connection to the vehicle body of the head car via the first connecting hole 71.

The cross beam 7 may be formed by assembly welding of plates. Specifically, the cross beam 7 may be configured as an L-shaped structure. That is, the cross beam 7 is formed by welding of two plates intersecting with each other at an angle, or may be formed by bending a single plate into an L-like shaped structure. The two ends of the cross beam 7 are respectively welded to the longitudinal sills 3 located at the two sides for easily connecting the cross beam 7 to the tail part of the head car cowcatcher. The first hole 71 may be opened in an end surface of the cross beam 7 located at the rear side to facilitate the connection to the vehicle body of the head car, specifically the end surface may be the airtight wall at the front end of the driver's cab.

Furthermore, a connection hanger bracket 8 may be further provided at a top surface of the longitudinal sill 3, and a second connecting hole 81 may be further opened in the connection hanger bracket 8, to facilitate the connection to an underframe of the head car via the second connecting hole 8, specifically facilitate the connection to a suspension side beam of the underframe, thus easily hanging the entire head car cowcatcher under the underframe.

Besides, the rear end of the head car cowcatcher is fixed to the airtight wall of the driver's cab via the first connecting holes 71 opened in the cross beam 7. In this way, the entire head car cowcatcher is fixed and thus can withstand various impact loads in transverse, longitudinal and vertical directions.

Terms of "first" and "second" are only used to distinguish different components of the same or similar structures and not intended to define a certain sequence.

Of course, those skilled in the art may choose other connection ways to realize the positioning of the head car cowcatcher as required, and the connection ways are not limited to the above way. The connection way of the head car cowcatcher may be improved according to the conventional technology and will not be described in details herein.

A rail vehicle is further provided according to the present application. The rail vehicle specifically includes the above head car cowcatcher, thus obtaining the technical effects generated by the above head car cowcatcher.

It should be illustrated that, there are various kinds of rail vehicles, the components of the head cars of the various kinds of rail vehicles are diverse, and the structures of respective components are complicated. Only the head car cowcatcher of the rail vehicle is described herein in detail. Other details which are not described herein may refer to the conventional technology and would not be described in detail herein.

A rail vehicle and a head car cowcatcher thereof according to the present application are described in detail hereinbefore. The principle and the embodiments of the present application are illustrated herein by specific examples. The above description of examples is only intended to help the understanding of the idea of the present application. It should be noted that, for those skilled in the art, a few of modifications and improvements may be made to the present application without departing from the principle of the present application, and these modifications and improvements are also deemed to fall into the scope of the present application defined by the claims.

The invention claimed is:

1. A head car cowcatcher of a rail vehicle, comprising:

a flow guiding plate;

a front-end frame mounted at a front end of an inner side surface of the flow guiding plate; and longitudinal sills mounted to the inner side surface and located at two sides of the flow guiding plate respectively;

wherein two ends of the front-end frame are connected to the longitudinal sills located at the two sides, respectively, and a rigidity of a connecting part of each of the longitudinal sills and the front-end frame is smaller than a rigidity of any parts of the longitudinal sills and the front-end frame, wherein the front-end frame and the longitudinal sills are formed by assembly welding of plates, and a thickness of the plates for the connecting part is smaller than a thickness of the plates for any parts of the longitudinal sills and the front-end frame.

2. The head car cowcatcher according to claim 1, wherein a transverse size of the plates for the connecting part is smaller than a transverse size of the plates for any parts of the longitudinal sills and the front-end frame.

3. The head car cowcatcher according to claim 2, wherein the flow guiding plate is arranged in a V shape, and the front-end frame is in a sector shape and is welded to a top surface of the flow guiding plate.

4. The head car cowcatcher according to claim 1, wherein the connecting part of each longitudinal sill and the front-end frame is made of a material with a rigidity smaller than rigidities of materials of the longitudinal sills and the front-end frame.

5. The head car cowcatcher according to claim 4, wherein the flow guiding plate is arranged in a V shape, and the front-end frame is in a sector shape and is welded to a top surface of the flow guiding plate.

6. The head car cowcatcher according to claim 1, wherein a through hole is opened in a front end of each of the longitudinal sills to allow the front end of each of the longitudinal sills to be connected to the front-end frame to form the connecting part.

7. The head car cowcatcher according to claim 6, wherein the flow guiding plate is arranged in a V shape, and the front-end frame is in a sector shape and is welded to a top surface of the flow guiding plate.

8. The head car cowcatcher according to claim 1, wherein the flow guiding plate is arranged in a V shape, and the front-end frame is in a sector shape and is welded to a top surface of the flow guiding plate.

9. The head car cowcatcher according to claim 8, wherein an obstruction removing plate is connected to a front end of the flow guiding plate, and obstruction removing rubbers are connected to two sides of the flow guiding plate respectively.

10. The head car cowcatcher according to claim 8, wherein a cross beam is connected to rear ends of the longitudinal sills, and the cross beam is provided with a first connecting hole for the connection to a body of a head car.

11. The head car cowcatcher according to claim 10, wherein a connection hanger bracket is provided at a top surface of each of the longitudinal sills, and the connection hanger bracket is provided with a second connecting hole for connection to an underframe of the head car.

12. A rail vehicle, comprising the head car cowcatcher according to claim 1.

* * * * *